US005822872A

United States Patent [19]

Waki

[11] Patent Number: 5,822,872

[45] Date of Patent: Oct. 20, 1998

[54] OPEN BLADE REAR SIGHT FOR PISTOL, RIFLE OR SHOTGUN

[76] Inventor: Matthew Waki, 353 Scott Ave., Salt Lake City, Utah 84115

[21] Appl. No.: 785,784

[22] Filed: Jan. 21, 1997

[51] Int. Cl.[6] ..... F41G 3/00

[52] U.S. Cl. ..... 33/235; 33/252; 42/100

[58] Field of Search ..... 33/233, 235, 241, 33/242, 243, 252, 253, 254, 255, 256, 257, 258, 259, 260, 261; 22/109, 110; 42/100

[56] References Cited

U.S. PATENT DOCUMENTS

| | | | |
|---|---|---|---|
| 189,721 | 4/1877 | Freund | 33/243 |
| 1,043,678 | 11/1912 | Bertouch | 33/243 |
| 1,265,766 | 5/1918 | Fessenden | 33/233 |
| 1,275,730 | 8/1918 | Pasznicki | 33/233 |
| 1,306,879 | 6/1919 | Boone | 33/241 |
| 2,208,576 | 7/1940 | Garand | 33/254 |
| 4,479,307 | 10/1984 | Pomeranz | 33/233 |

FOREIGN PATENT DOCUMENTS

| | | | |
|---|---|---|---|
| 1245580 | 10/1960 | France | 33/233 |
| 37524 | 11/1923 | Germany | 33/233 |
| 28973 | 6/1914 | United Kingdom | 33/233 |

*Primary Examiner*—Christopher W. Fulton
*Assistant Examiner*—Andrew Hirshfeld
*Attorney, Agent, or Firm*—Terry M. Crellin

[57] ABSTRACT

A rear gunsight has a rectangular-shaped base member, with a left sidewall extending upwardly from a left hand side of the base member and a right sidewall extending upwardly from a right hand side of the base member. A left hand top element extends from an upper end of the left sidewall toward the right sidewall, and a right hand top element extends from an upper end of the right sidewall toward the left sidewall. The base, the sidewalls and the top elements enclose a hollow space that is open at a front end and a rear end of the gunsight so that one can see through the hollow space. A notch is formed between the terminal ends of the right and left hand top elements, and the notch opens into the hollow space as well as being open at its opposite ends so that one can see through the notch simultaneously with seeing through the hollow space. A boss extends upwardly into the hollow space from the planar upper surface of the base member, with the boss being positioned centrally between the left and right sidewalls so that two spaced apart sight chambers are formed on opposite sides of the boss. The boss has a flat upper surface that is spaced from the left and right hand top elements so that an open passage is formed between the notch and each of the sight chambers.

12 Claims, 1 Drawing Sheet

OPEN BLADE REAR SIGHT FOR PISTOL, RIFLE OR SHOTGUN

BACKGROUND OF THE INVENTION

1. Field of the Invention

The present invention relates to rear sights used on firearms including pistols, rifles and shotguns.

2. State of the Art

Traditional rear sights for a firearm comprise an opaque block having a sight notch formed in the upper surface of the block. The rear sights of the prior art block the view of the target and front sight because they are solid and opaque. The user cannot see any portion of the target or the front sight that is in a field below the upper surface of the rear sight.

The inventor has made a search of prior U.S. Patents and has been unable to find any suggestion is the prior patents of a rear sight that has an open space beneath the notch of the sight, wherein the target and the front sight can be seen in the open space as the sight is being used. The inventor has been unable to find any suggestion whatsoever of providing a rear gunsight which has an opening below the square or rectangular notch found in the upper surface of the sight.

OBJECTIVES AND BRIEF DESCRIPTION OF THE INVENTION

A principal objective of the invention is to provide a novel, rear sight for a pistol, rifle or shotgun which will allow the user to view the target and front sight in a pair of sight chambers which are located within the sight below notch in the sight.

A further objective of the present invention is to provide such a rear sight that has a sight chamber formed beneath the notch in the rear sight, with the sight chamber having a boss or stud centered in the sight chamber and located immediately below the notch in the sight.

A still further objective of the present invention is to provide a rear sight with such a sight chamber and central boss, wherein the boss has a planar upper surface that is positioned immediately below the notch while also being spaced from the notch to form an open passage between the notch and each of the sight chambers on the opposite sides of the boss.

The above objectives are achieved in accordance with the present invention by providing a novel rear sight that has a sight chamber located immediately beneath the notch in the upper surface of the sight. The sight chamber is preferably divided into two smaller chambers by a central boss that extends upwardly from the bottom of the larger sight chamber, with the central boss being positioned immediately beneath the notch in the sight. In a preferred embodiment, the top surface of the boss is spaced from the notch so that an open channel is formed between the notch and each of the smaller of the chambers forming the sight chamber. By having a line of sight beneath the notch, the front sight and the target can be viewed even though it is below the top surface of the sight. The two chambers on each side of the boss allow the front sight and the target to be viewed on each side of the boss, and the open passages between the two chambers and the notch allow viewing of the sides of the front sight and target.

The sight of the present invention allows rapid shots to be taken at various targets or various portions of a target at close range where approximate alignment must be made quickly but precise alignment is not necessary. Since the front sight can be seen all the way around the centered position, including below the top of the rear sight, in situation where only approximate alignment is required, the user can make the alignment very quickly with the rear sight of the present invention. In a preferred embodiment of the sight of the present invention, wherein the sides of the central boss are tapered so as to contrast with the vertical sides of the front sight, quick windage centering of the front sight with the rear sight is possible. The rear sight of the present invention also allows precise alignment of the front sight with the rear sight inasmuch as the rear sight includes a notch as in standard rear sights for making such precise alignment.

Additional objects and features of the invention will become apparent from the following detailed description, taken together with the accompanying drawings.

THE DRAWINGS

Preferred embodiments of the present invention representing the best mode presently contemplated of carrying out the invention are, illustrated in the accompanying drawings in which.

DETAILED DESCRIPTION OF THE ILLUSTRATED EMBODIMENTS

Figure 1:
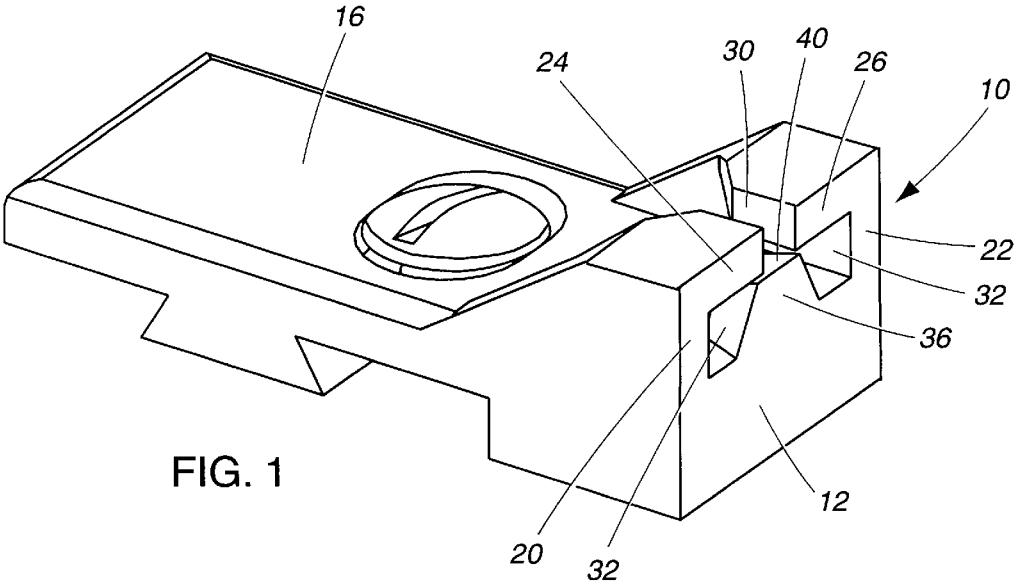
FIG. 1 is a pictorial representation of a rear gunsight in accordance with the present invention.

Referring now to the drawings, a rear gunsight 10 is shown. The gunsight 10 comprises a substantially rectangular-shaped base member 12 that has an essentially planar upper surface 14. As shown in FIG. 1, the gunsight 10 has a mounting mechanism 16 that extends forwardly from the base member 12. The mounting mechanism 16 is used to mount the gunsight 10 to a firearm. The mounting mechanism 16 is well known in the prior art and will not be discussed further herein.

Figure 2:
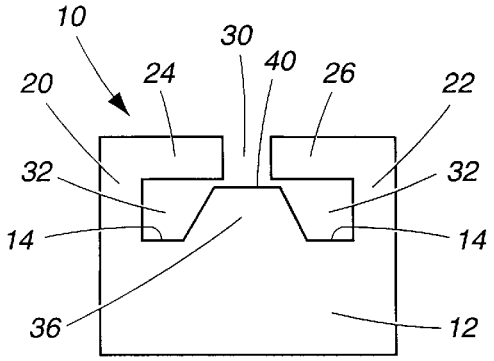
FIG. 2 is an end view of the gunsight of FIG. 1 taken from the right side of FIG. 1.
Figure 3:
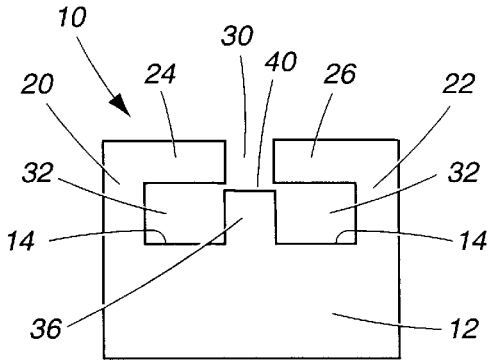
FIG. 3 is a view similar to FIG. 2 showing two modifications to the gunsight of FIGS. 1 and 2.
Figure 4:
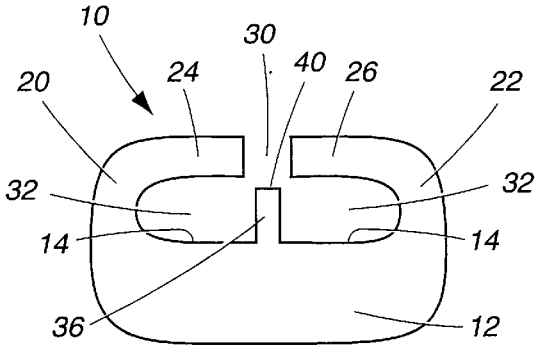
FIG. 4 is yet another view similar to FIG. 2 showing yet another two modification to the gunsight of FIGS. 1 and 2.

A left sidewall 20 extends upwardly from a left hand side of the base member 12, and a right sidewall 22 extends upwardly from a right hand side of the base member 12. As illustrated in FIGS. 1-3, the sidewalls 20 and 22 are essentially flat, planar members that extend upwardly from the base member 12 so as to be substantially perpendicular to the planar upper surface 14 of the base member 12. In a modified embodiment shown in FIG. 4, the sidewalls 20 and 22 extend upwardly from the base member 12 in curved arcs that bulge outwardly away from each other.

A left hand top element 24 extends from an upper end of the left sidewall 20 toward the right sidewall 12, and a right hand top element 26 extends from an upper end of the right sidewall 22 toward the left sidewall 20. The left and right hand top elements 24 and 26 are essentially parallel with the base member 12, or at least, the upper surfaces of the top elements 24 and 26 are substantially parallel with the upper surface 14 of the base member 12.

The terminal ends of the top elements 24 and 26 are spaced apart from each other and form a notch 30. The notch 30 is preferably located equidistant from the left sidewall 20 and right sidewall 22. The notch 30 extends from the front end to the rear end of the gunsight 10 so that one can see through the notch 30 along the longitudinal dimension of the notch 30. A hollow space 32 is enclosed by the base member 14, the left and right sidewalls 20 and 22 and the left and right hand top elements 24 and 26. Like the notch 30, the hollow space 32 is open at a front end and rear end of said gunsight 10 so that one can see through the hollow space looking from the rear end of the gunsight 10 toward the front end of the gunsight 10. The bottom of the notch 30 opens into the hollow space 32. One can simultaneously see through the notch 30 and the hollow space 32 looking from the rear end of the sight 10 toward the front end of the sight.

A stud or boss 36 extends upwardly into the hollow space 32 from the planar upper surface 14 of the base member 12. The boss 36 is spaced from each of the left and right sidewalls 20 and 22, preferably by and equal dimension so that the hollow space 32 is divided into two spaced apart sight chambers through which one can see through simultaneously when looking from the rear end of the sight 10 toward the front end of the sight. The boss 36 has a substantially flat upper surface 40 that is spaced from the left hand and right hand top elements 24 and 26 so that an open passage is formed between the notch 30 and each of the two sight chambers in the hollow space 32. The flat upper surface 40 of the boss 36 further forms an effective flat bottom surface for the notch 30.

In a preferred embodiment of the gunsight 10 in accordance with the present invention, as shown in FIGS. 1 and 2, the opposite sides of the boss 36 face left and right sidewalls 20 and 22, respectively, with the opposite sides of the boss 36 slanting outwardly from the upper surface of the boss 36 toward the respective left and right sidewalls 20 and 22.

As shown in the embodiment of the gunsight illustrated in FIGS. 1, 2 and 3, it is advantageous to provide the boss 36 with a width sufficient that the flat upper surface 40 of the boss 36 extends at least completely beneath the notch 30, with the flat upper surface 40 of the boss 36 being spaced from the left hand and right hand top elements 24 and 26 to form the open passage between the notch and each of the two sight chambers in the hollow space 32. However, it should be recognized that the width of the boss 36 can be less than that sufficient to extend completely beneath the notch 30. Such a narrow boss 36 is shown in the embodiment of the invention illustrated in FIG. 4. In the most preferred embodiment of the invention, as illustrated in FIGS. 1 and 2, the top surface 40 of the boss 36 has a width sufficient to extend completely beneath the notch 30 and further extend beneath a portion of each of the left hand and right hand top elements 24 and 26.

Although preferred embodiments of the gunsight 10 of the present invention have been illustrated and described, it is to be understood that the present disclosure is made by way of example and that various other embodiments are possible without departing from the subject matter coming within the scope of the following claims, which subject matter is regarded as the invention.

I claim:

1. A rear gunsight comprising a substantially rectangular-shaped base member having an essentially planar upper surface;

a left sidewall extending upwardly from a left hand side of said base member;

a right sidewall extending upwardly from a right hand side of said base member;

a left hand top element extending from an upper end of said left sidewall toward said right sidewall;

a right hand top element extending from an upper end of said right sidewall toward said left sidewall;

a hollow space enclosed by said base, said left and right sidewalls and said left and right hand top elements, said hollow space being open at a front end and a rear end of said gunsight so that one can see through said hollow space;

terminal ends of said right hand and left hand top elements being spaced apart to form a notch that extends from the front end to the rear end of said gunsight, with said notch opening into said hollow space as well as being open at its opposite ends so that one can see through said notch simultaneously with seeing through said hollow space;

a boss that extends upwardly into said hollow space from the planar upper surface of said base member;

said boss being spaced from each of said left and right sidewalls by an equal dimension so that two spaced apart sight chambers through which one can see simultaneously are formed on opposite sides of said boss;

said boss has a substantially flat upper surface that is spaced from said left hand and right hand top elements so that an open passage is formed between said notch and each of said sight chambers; and said boss has a width sufficient that the flat upper surface of said boss extends beneath said notch for at least the entire width of said notch, with said flat upper surface of said boss being spaced from said left hand and right hand top elements to form said open passage between said notch and each of said sight chambers.

2. A rear gunsight in accordance with claim 1 wherein said left and right sidewalls extend upwardly from said base member so as to be substantially perpendicular to the planar upper surface of said base member.

3. A rear gunsight in accordance with claim 1 wherein said left and right sidewalls extend upwardly from said base member in outwardly curved arcs.

4. A rear gunsight in accordance with claim 1 wherein opposite sides of said boss face said left and right sidewalls, respectively, with said opposite sides of said boss slanting outwardly from the upper surface of said boss toward the respective left and right sidewalls.

5. A rear gunsight in accordance with claim 4 wherein said left and right sidewalls extend upwardly from said base member so as to be substantially perpendicular to the planar upper surface of said base member.

6. A rear gunsight in accordance with claim 4 wherein said left and right sidewalls extend upwardly from said base member in outwardly curved arcs.

7. A rear gunsight in accordance with claim 1 wherein said boss has a width sufficient that the flat upper surface of said boss extends completely beneath said notch and beneath a portion of each of said left hand and right hand top elements.

8. A rear gunsight in accordance with claim 7 wherein said left and right sidewalls extend upwardly from said base member so as to be substantially perpendicular to the planar upper surface of said base member.

9. A rear gunsight in accordance with claim 7 wherein said left and right sidewalls extend upwardly from said base member in outwardly curved arcs.

10. A rear gunsight in accordance with claim 7 wherein opposite sides of said boss face said left and right sidewalls, respectively, with said opposite sides of said boss slanting outwardly from the upper surface of said boss toward the respective left and right sidewalls.

11. A rear gunsight in accordance with claim 10 wherein said left and right sidewalls extend upwardly from said base member so as to be substantially perpendicular to the planar upper surface of said base member.

12. A rear gunsight in accordance with claim 10 wherein said left and right sidewalls extend upwardly from said base member in outwardly curved arcs.

* * * * *